US008752653B2

(12) United States Patent
Seneviratne et al.

(10) Patent No.: US 8,752,653 B2
(45) Date of Patent: Jun. 17, 2014

(54) DUAL BALL UPPER INTERNAL BLOW OUT PREVENTER VALVE

(75) Inventors: Padmasiri Daya Seneviratne, Fullerton, CA (US); Lawrence E. Wells, Yorba Linda, CA (US); Arthur W. Braman, Cypress, CA (US); Preston R. Fox, Fountain Valley, CA (US)

(73) Assignee: National Oilwell Varco, L.P., Houston, TX (US)

( * ) Notice: Subject to any disclaimer, the term of this patent is extended or adjusted under 35 U.S.C. 154(b) by 495 days.

(21) Appl. No.: 13/045,423

(22) Filed: Mar. 10, 2011

(65) Prior Publication Data

US 2011/0226485 A1 Sep. 22, 2011

Related U.S. Application Data

(60) Provisional application No. 61/312,786, filed on Mar. 11, 2010.

(51) Int. Cl.
*E21B 21/10* (2006.01)
*E21B 33/06* (2006.01)

(52) U.S. Cl.
USPC ..... 175/218; 166/332.3; 137/613; 251/1.1

(58) Field of Classification Search
USPC ..... 175/218; 166/330, 332.3, 334.2, 332.1; 137/613; 251/340, 1.1
See application file for complete search history.

(56) References Cited

U.S. PATENT DOCUMENTS

| | | | | |
|---|---|---|---|---|
| 3,509,913 | A * | 5/1970 | Lewis | 137/614.11 |
| 5,806,563 | A | 9/1998 | Rabby | |
| 7,121,295 | B2 | 10/2006 | Seneviratne et al. | |
| 7,287,544 | B2 | 10/2007 | Senevirante et al. | |
| 7,461,698 | B2 | 12/2008 | Klipstein | |

FOREIGN PATENT DOCUMENTS

GB 2 129 033 A 5/1984

OTHER PUBLICATIONS

International Search Report dated Jan. 11, 2013, for PCT/US2011/027991, 10 pgs.
Office Action dated Aug. 27, 2013 in Canadian Patent Application No. 2,792,753, 3 pgs.

* cited by examiner

*Primary Examiner* — Kenneth L Thompson
*Assistant Examiner* — Wei Wang
(74) *Attorney, Agent, or Firm* — Christie, Parker & Hale, LLP

(57) ABSTRACT

An internal blowout preventer used in drilling rigs for the discovery and production of hydrocarbons from the earth is disclosed. The internal blowout preventer has two independently and remotely operable blowout preventer valves in the same body, providing for greater service life and higher reliability during drilling operations. The two valves are loaded into the internal blowout preventer housing from a single end, and are operable by an actuator assembly.

22 Claims, 9 Drawing Sheets

DUAL BALL UPPER INTERNAL BLOW OUT PREVENTER VALVE

CROSS-REFERENCE TO RELATED APPLICATIONS

This application claims priority to and the benefit of U.S. Provisional Application No. 61/312,786, filed Mar. 11, 2010, the entire contents of which are expressly incorporated herein by reference.

BACKGROUND OF THE INVENTION

1. Field of the Invention

This disclosure relates to the field of oilfield drilling equipment. In particular, this disclosure is drawn to an internal blowout preventer of a top drive system used in drilling rigs for the discovery and production of hydrocarbons from the earth.

2. Description of the Related Art

Internal blowout preventers (IBOPs) are valves designed to contain down-hole pressure and prevent blowouts in high pressure drilling applications. The IBOP includes a valve that can be closed in order to contain fluid from flowing out of the well. Regulations in some geo-political areas require two IBOPs (referred to as an upper IBOP and a lower IBOP) at the top of the well, for safety redundancy. Both the lower and the upper IBOP are tested periodically, such as weekly, to confirm that both valves hold a sufficient pressure without leaking. Other than this periodic testing, the lower IBOP valve is typically used only in the event of an emergency, such as a well blow-out. However, the upper IBOP valve is also used as a mud saver valve to contain hydrostatic or mud pump pressure from above. That is, each time a stand of pipe (typically three pipe segments threaded together) is added to the string and lowered into the wellbore, the upper IBOP is closed prior to disconnecting the top drive from the drill string, in order to contain the drilling fluid or mud flowing through the top drive. With the upper IBOP closed, the top drive is disconnected from the drill string and the entire assembly is raised to accept a new stand of pipe. Thus the upper IBOP valve may be cycled many times per day as a mud saver valve, in addition to weekly testing and emergency use.

Due to this repeated cycling, the upper IBOP valve tends to be high maintenance, and has been known to fail in the field due to the turbulent and corrosive flow of mud or drilling fluid through the valve. Additionally, as mentioned above, both the upper and lower IBOP valves are subject to periodic hydrostatic pressure testing, and a test failure requires immediate replacement of the valve, leading to lost drilling time. The upper IBOP valve in particular is subject to frequent repair or replacement.

A typical known IBOP assembly includes both a lower IBOP and an upper IBOP, each IBOP including a single blow-out preventer valve. The two IBOPs may be coupled together through multiple separate assemblies. In many cases, regulations require the redundancy of an upper and a lower IBOP, as a safety requirement. In use, the seals on these valves are subject to high strain and wear, causing frequent failure. Because a back-up valve is always required, if one of the valves fails (such as failing a weekly pressure test), the backup is then put in operation only until it is possible to shut down the drilling operation to repair or replace the first failed valve. When one of these valves fails, drill operations must be suspended while the entire IBOP unit is replaced or while repairs are performed. Neither of these options is particularly appealing, however, due to cost and loss of time on the drill site. Repair or replacement of an upper IBOP valve is a time consuming process.

IBOP valves are important parts of a top drive system which is used to drill for oil and gas. Known top drive systems typically have an upper IBOP valve and a lower IBOP valve, as regulations require, which become parts of the drill string during drilling. Each IBOP typically has only a single valve. IBOP valves are used as pressure control valves in case of a pressure kick from the well bore. The upper and lower IBOPs are typically used in tandem to provide the required safety redundancy, which necessarily involves numerous additional pipe connections and steps, and adds additional length in the assembly. The upper IBOP valve is remotely operated and is also used as a mud saver valve when a drill string connection is broken to add a new section of drill pipe.

BRIEF SUMMARY OF THE INVENTION

According to embodiments of the present invention, a dual upper IBOP valve is provided, having two valves, such as ball valves, within a single housing. This dual upper IBOP assembly provides a second redundancy in the system, by providing both a main upper IBOP valve and a back-up upper IBOP valve. An actuator sleeve is provided to operate crank mechanisms for each valve, to open or close the valve as necessary. A dual upper IBOP valve with a quick engagement crank mechanism allows the upper IBOP to continue to be used even after failure of the first upper IBOP valve, by switching to the second upper IBOP valve. A dual upper IBOP can improve the drilling situation considerably by allowing the rig crew to schedule repair work on the problematic valve to a convenient time, rather than needing an immediate emergency repair or replacement.

The dual upper IBOP valve disclosed herein is an improvement over the existing single upper IBOP valve and can be used as a direct replacement of either a single upper IBOP valve (which does not provide the second redundancy) or two single upper IBOP valves connected in series (which add considerable length and additional connections to the assembly). In case of a failure of the first upper IBOP valve, the second upper IBOP valve in the dual upper IBOP can be used, thereby saving valuable drilling time until a repair or replacement procedure can be scheduled. The dual valves can be operated such that only one of the two valves in the dual upper IBOP valve is functional at a time, and the other is set up as a back-up valve. The dual upper IBOP valve is a candidate to improve performance, efficiency, and reliability of top drive systems.

During drilling operations and under normal maintenance of equipment, it is a requirement that the upper and lower IBOP valves be periodically pressure tested to maintain credibility. If either IBOP fails the test, it is mandatory that a new valve be installed immediately, before drilling may resume, even if the other IBOP passes the test. This requirement is mandatory so that the system always operates with two fully functional valves, for safety redundancy. As the upper IBOP valve is used far more frequently than the lower IBOP valve, for mud saving, the upper IBOP valve is more likely to fail a pressure test due to repeated wear. Replacing or repairing an upper IBOP valve is very time consuming, and the valve test failure may occur at a critical time of the drilling program. With only a single upper IBOP valve, drilling must be stopped regardless of the timing so that the valve can be replaced. This situation may compromise safety to achieve the required results and may also incur considerable expenses and delay. With the use of a dual upper IBOP, this kind of an emergency will be, for the most part, eliminated, as the back-up upper IBOP valve may be used until a repair or replacement can be scheduled at a convenient and safe time. The system can continue to operate with the required safety redundancy, by operating with the back-up upper IBOP valve and the lower IBOP valve, until the main upper IBOP valve can be repaired.

In the above described situation, a top drive system equipped with a new dual upper IBOP valve with its unique design allows the drilling crew to quickly switch to the back-up upper IBOP valve and continue drilling. The switch to the backup upper IBOP valve is achieved by disengaging the faulty upper IBOP valve and engaging the back-up upper IBOP valve with minimal effort and time. This capability allows the replacement or repair of the dual upper IBOP valve to be scheduled and performed when convenient.

According to one embodiment of the invention, a dual internal blowout preventer for oilfield drilling operations includes two complete independent blowout preventer assemblies independently operable in a single housing. In one embodiment, at least one of the internal blowout preventer assemblies is adapted to be operated remotely. In one embodiment, both of the internal blowout preventers are adapted to be operated remotely. In one embodiment, a single-end loaded, dual ball, upper internal blowout valve is provided for drilling operations. A quick change crank mechanism is also provided for use with a single end loading, dual ball, upper internal blowout valve.

In one embodiment, an internal blowout preventer (IBOP) for use in drilling operations includes a housing having first and second openings at opposite first and second ends of the housing, and having a flow passage between the openings. The IBOP also includes first and second valves located in the flow passage in the housing. Each valve is movable between an open position in which the flow passage is open and a closed position in which the flow passage is closed. The IBOP also includes an actuator assembly coupled to the housing for independently operating the first or second valve. The first and second valves are received into the housing through the first opening.

In another embodiment, a top drive drilling system includes a top drive with an output shaft. The top drive is configured to rotate the output shaft. The system also includes a dual internal blowout preventer (IBOP) coupled to the output shaft of the top drive. The IBOP includes a housing having a mud flow passage, and first and second ball valves located in series in the mud flow passage. Each ball valve is rotatable between open and closed positions to open or close the mud flow passage. The IBOP also includes first and second internal crank mechanisms coupled to the respective first and second ball valves, an actuator coupled to the housing and movable with respect to the housing, and first and second external cranks coupled between the actuator and the respective first and second internal crank mechanisms. Movement of the first or second external crank by the actuator causes rotation of the respective first or second ball valve between the open and closed positions.

In another embodiment, a method for operating an internal blowout preventer in a top drive drilling system includes providing an internal blowout preventer with a housing having first and second openings at opposite first and second ends of the housing. The method includes loading first and second valves into the housing through the first opening, mounting an actuator sleeve to the housing and coupling the actuator sleeve to the first valve, configuring the actuator sleeve to operate the first valve, and translating the actuator sleeve to operate the first valve.

DETAILED DESCRIPTION OF THE INVENTION

Figure 1:
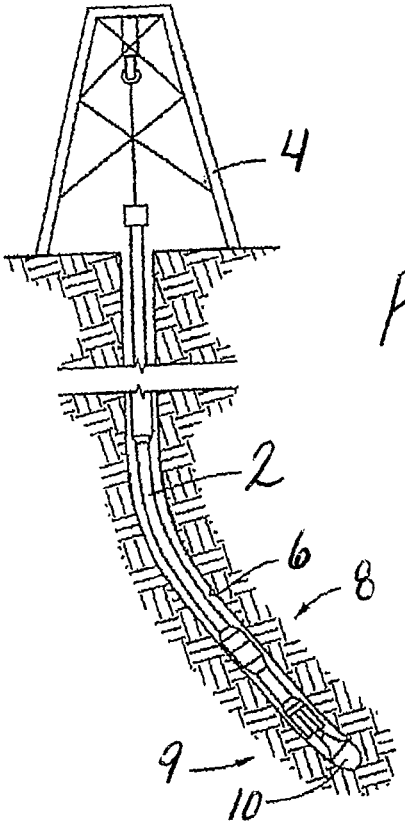
FIG. 1 is a partial section and schematic view of an arrangement of a drilling rig for drilling boreholes into the earth according to an embodiment of the invention.

FIG. 1 shows a drill string 2 suspended by a derrick 4 for drilling a borehole 6 into the earth for minerals exploration and recovery, and in particular the recovery of petroleum or natural gas. A bottom-hole assembly (BHA) 8 is located at the bottom of the borehole 6 and comprises a drill bit 10. In directional drilling, the BHA 8 may have a downhole steerable drilling system 9.

As the drill bit 10 rotates down hole, it cuts into the earth allowing the drill string 2 to advance, forming the borehole 6. For the purpose of understanding how these systems may be operated, for the type of steerable drilling system 9 illustrated in FIG. 1, the drill bit 10 may be one of numerous types well known to those skilled in the oil and gas exploration business. This is just one of many types and configurations of bottom hole assemblies 8, however, and is shown only for illustration. There are numerous downhole arrangements and rig and equipment configurations possible for use for drilling boreholes into the earth with top drive systems 12, and the present disclosure is not limited to the particular configurations as detailed herein.

Figure 2:
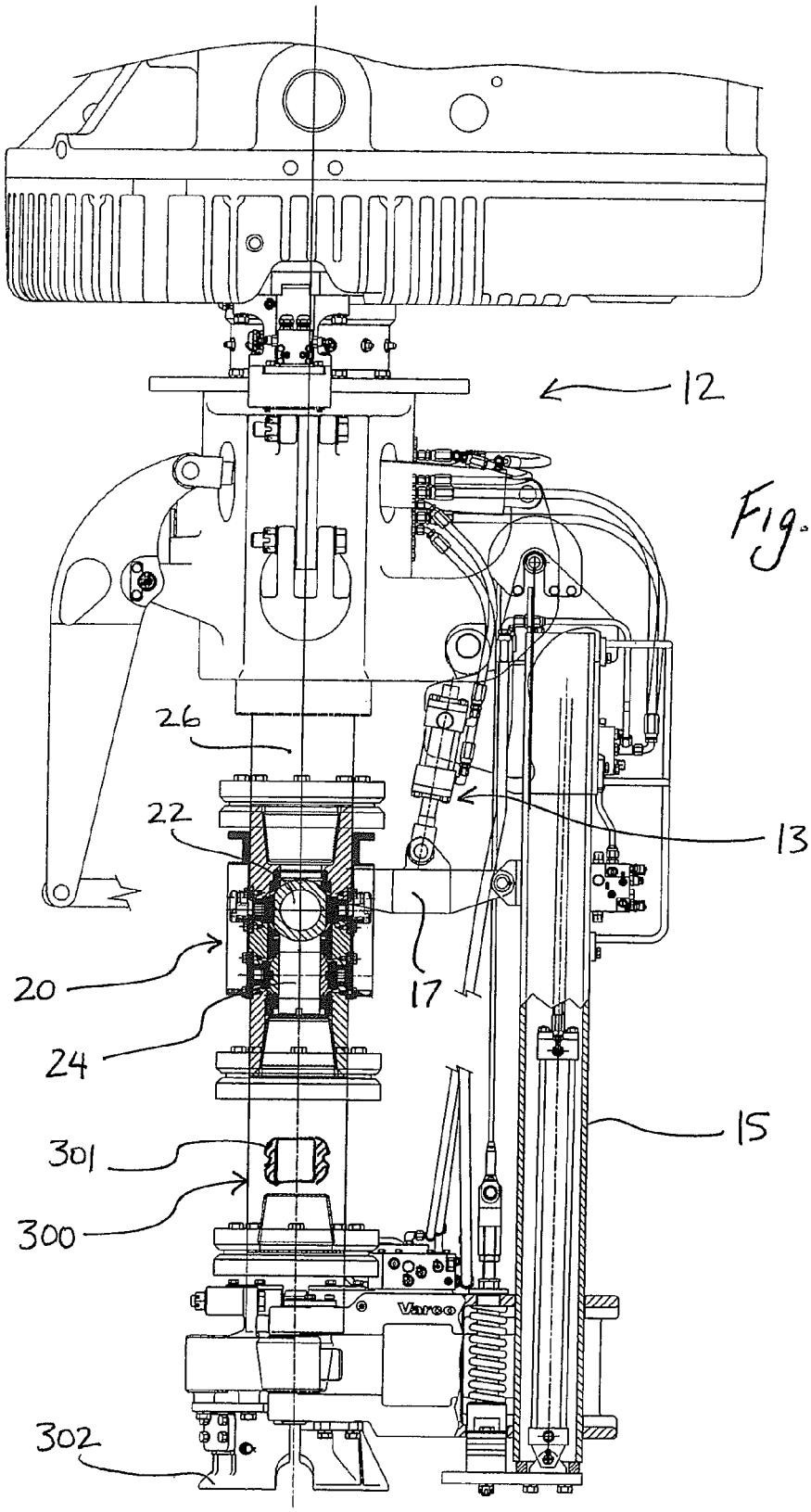
FIG. 2 is a partial side and partial cross-sectional view of a top drive drilling system illustrating the arrangement of a dual upper internal blowout preventer, and its placement on the drilling rig, according to an embodiment of the invention.
Figure 3:
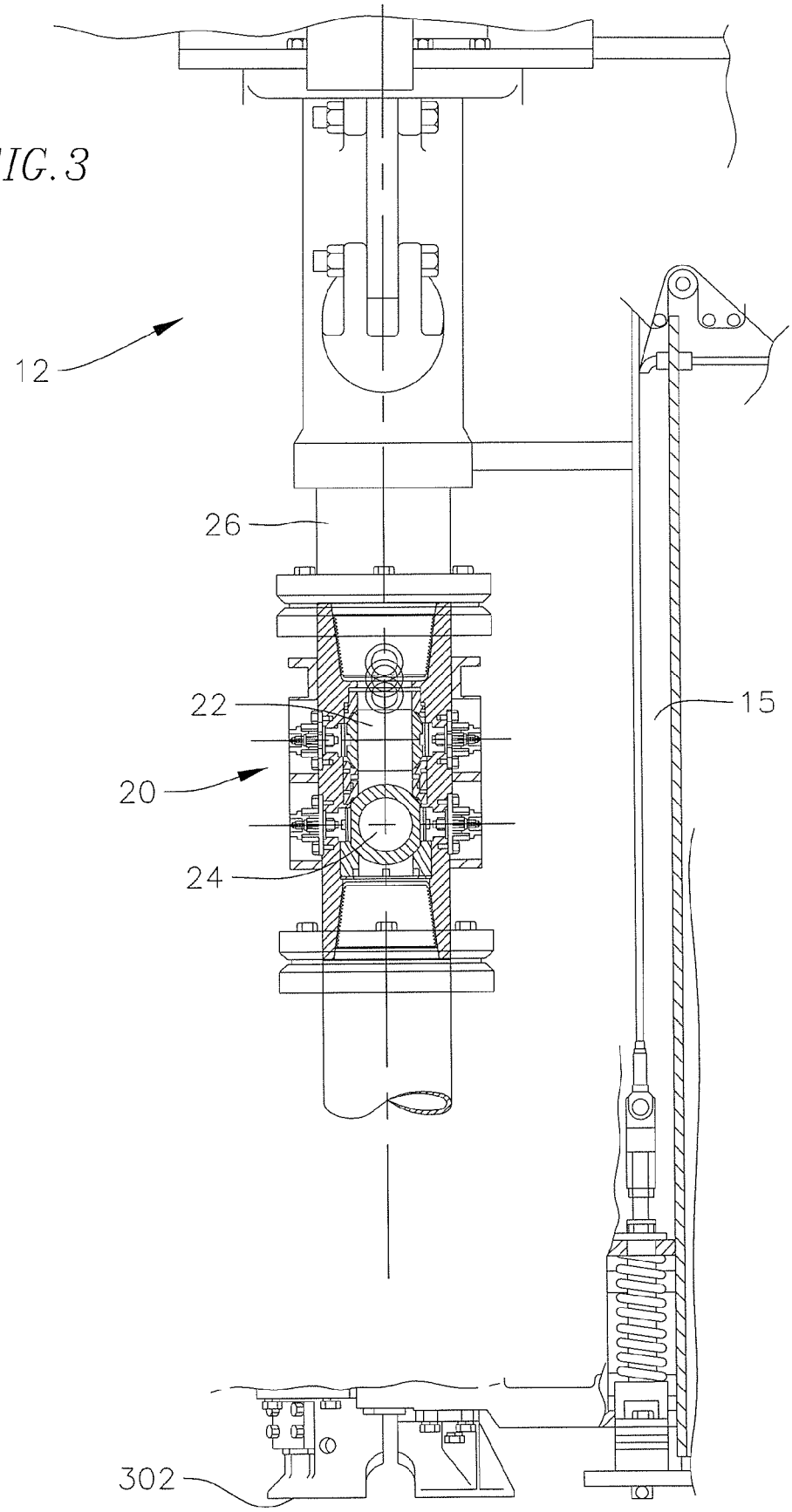
FIG. 3 is another partial section view showing in greater detail the arrangement of selected components of the top drive drilling rig of FIG. 2 and in particular one arrangement of the dual upper internal blowout preventer.

FIGS. 2 and 3 are side views of components of a drilling rig top drive system 12 according to an embodiment of the present invention. A dual ball upper internal blowout preventer (IBOP) 20 according to an embodiment of the present invention is mounted to the rig along with other components of the top drive drilling rig, including a yoke 17, a pipe handler frame 15, and a hydraulic cylinder 13 (FIG. 2). The dual ball upper IBOP 20 includes two ball valves 22, 24 inside a single housing. The first upper IBOP valve 22 and the second upper IBOP valve 24 are both adapted for controlling well pressure and drilling mud flow. FIG. 2 shows the relative location of the upper IBOP valves 22, 24 with respect to the other drilling rig components. A single valve lower IBOP 300 with single ball valve 301 is connected below the dual upper IBOP 20. Below the lower IBOP 300 is a bell-mouth 302 which receives the top end of a pipe segment or pipe stand.

As shown in FIG. 3, the dual ball upper IBOP 20 is connected to the main output shaft 26 of the top drive system 12, and is exemplary of one manner in which this dual ball upper IBOP 20 may be implemented on a drill rig with a top drive system 12. In one embodiment the IBOP 20 is threaded directly to the output shaft 26. The output shaft 26 is rotated by the top drive 12. The dual ball upper IBOP 20 is not limited only to these types of drilling systems. The dual ball upper IBOP 20 with first and second valves 22, 24 is connected to the top drive system 12 and forms a part of the drill string, as indicated in FIGS. 2 and 3.

Figure 4:
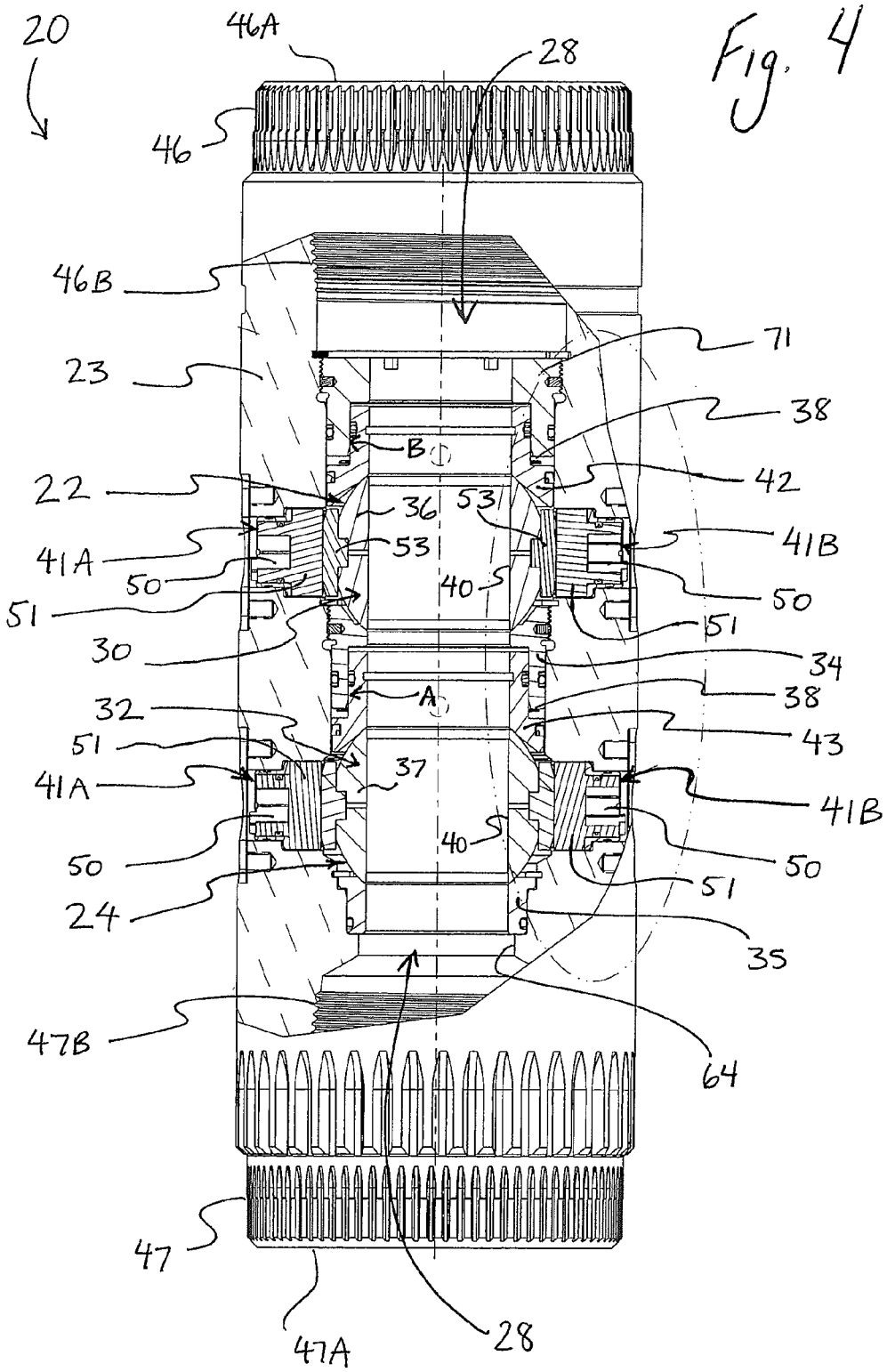
FIG. 4 is a partial cross-sectional view of a dual ball upper internal blowout preventer according to an embodiment of the invention.

Turning to FIG. 4, a detailed view of a dual upper IBOP 20 is shown according to an embodiment of the invention. The dual upper IBOP 20 includes two separate valve assemblies 22, 24 and is referred to as a "dual" upper IBOP. The dual upper IBOP 20 includes a mud flow passage 28 through the center of the IBOP, along the central longitudinal axis of the IBOP. Each valve assembly 22, 24 can be rotated through 90 degrees to open or close the valve to allow or block mud flow through the IBOP 20. The dual upper IBOP 20 may replace an existing single upper IBOP valve in a typical drill rig. Further details of the dual upper IBOP 20 are described below, including the arrangement of the valves 22, 24, the actuating mechanism, the single-end loading capability, and the compact length.

In one embodiment, the dual upper IBOP valve assembly 20 consists of two substantially independent valve assemblies 22, 24 inside a single IBOP housing 23. In one embodiment, the two IBOP valve assemblies 22, 24 each include a ball valve 30, 32, and the IBOP may be referred to as a dual ball upper IBOP. In other embodiments, the valves 22, 24 could be plug valves or other suitable valves. The first valve 22 may be located at the top, above the second valve, and the second valve 24 may be located at the bottom, or vise versa. When the dual upper IBOP 20 is installed, one valve is identified as the primary valve, and the other valve as the back-up valve. Either valve may function as the primary valve. In one embodiment, the first valve 22 is the primary functioning IBOP valve, and the second valve 24 is the back-up IBOP valve.

As mentioned, the valves 22, 24 may be ball valves 30, 32, as shown in FIG. 4. In one embodiment, each ball valve 30, 32 is similar to a ball valve in a single upper IBOP valve. In other embodiments, the valves 22, 24 may have other designs, depending on system requirements and interchangeability. In one embodiment, the dual upper IBOP assembly 20 occupies the same space in the drill string as an existing single upper IBOP valve. Thus, an existing drilling rig with a single upper IBOP valve can be retrofitted with a dual upper IBOP 20 by simply removing the single upper IBOP valve and replacing it with the dual upper IBOP 20, without adding any additional length or width to the drill string.

The ball valves 30, 32 each include a generally spherical ball 36, 37. Each ball is seated between a fixed seat 34, 35 and a floating seat 42, 43 with proper sealing arrangements. The fixed and floating seats provide arcuate surfaces that rest against the balls 36, 37 to trap the balls inside the IBOP housing 23. The fixed seats 34, 35 are fixed to the IBOP housing 23 such as by threads or other mechanical fasteners. The floating seats 42, 43 are biased against other components to apply a force to the respective ball 36, 37 to hold the ball in place between the two seats. In one embodiment, one or more springs 38, such as a wavy circular spring or other type of spring, urges against the floating seats 42, 43, forcing the seat against the respective spherical ball 36, 37. The spring and floating seat thereby urge the ball against the fixed seat 34, 35 on the other side of the ball. In the event that the ball valve is closed against pressure from the wellbore, the pressure from the wellbore lifts the ball 36, 37 from the respective fixed seat 34, 35 and presses the ball against the respective floating seat 42, 43. The contact of the ball against the arcuate surface of the floating seat creates a pressure seal along the contact area between the ball and the floating seat, to contain pressure from the well. In the event of pressure from above, such as the comparatively low pressure from the mud pump, the floating seat 42, 43 urges the ball 36, 37 against the fixed seat 34, 35 below the ball to create a positive seal.

A mud flow passage 28 through the center of the IBOP continues through the ball and seat components. Each ball 36, 37 includes a bore 40 through the ball, and the bore can be aligned with the mud flow passage 28 through the IBOP to allow mud flow. The ball can be rotated through 90 degrees to move a solid side of the ball into the mud flow passage 28, blocking further passage of mud or other fluid through the IBOP 20 (shown in FIG. 5).

Each ball 36, 37 is connected to two internal crank assemblies, one on each side of the ball, identified as 41A and 41B respectively. It should be noted that in other embodiments, each ball may be connected to only one crank assembly. These internal crank assemblies 41A, 41B are located within the housing 23. Each assembly 41A, 41B includes an internal crank 51 connected to a universal coupling 53. The coupling 53 fits into a slot in the side of each ball. Each crank 51 has a hexagonal opening 50 on the outer side, facing away from the ball, for engagement with an external crank assembly which is used to rotate the ball between open and closed positions, as described in more detail below. In other embodiments, the opening 50 can take other suitable shapes other than hexagonal, such as the shape of a square, triangle, or star.

As mentioned above, in one embodiment, the dual upper IBOP 20 includes two valves 22, 24 inside a single housing 23. The single housing 23 reduces the number of external connections or couplings that would otherwise be needed to connect two separate valve assemblies together. The housing 23 includes an upper end 46 and a lower end 47. The upper end 47 is toward the top drive system 12, and the lower end 47 is toward the borehole 6.

Both valve assemblies 22, 24 (including the valve and associated seats, springs, seals, and other components) can be loaded into the housing 23 from the same end, in one embodiment the upper end 46. That is, the dual upper IBOP valve assembly 20 has the capability of being assembled from one end of the housing 23, and as such be characterized as a "single end loading" dual upper IBOP valve. This capability is shown in FIG. 4, where both valves 22, 24 are loaded into the housing 23 through the upper end 46. The upper and lower ends 46, 47 each have an opening 46A, 47A that communicates with the mud flow passage 28 through the IBOP. Each opening may have internal threads 46B, 47B. The opening 46A and the mud flow passage 28 through the upper end 46 are wide enough in diameter to receive the valves 22, 24. The valve 24 can be received into the IBOP housing 23 through the opening 46A, arranged between seats 35 and 43, and subsequently the other valve 22 can be loaded into the IBOP and seated above the lower valve 24. A retainer ring 71 is provided above the valve 22, capturing the spring 38 between the ring 71 and the floating seat 42. The diameter of the opening 46A is selected to be wide enough to receive these valves and seats and corresponding components into the housing 23. It should be noted that the IBOP can be designed to provide single-end loading from either the upper end 46 or the lower end 47. The embodiment of FIG. 4 provides loading from the upper end 46. In either case, the two valves are both loaded from the same end, and are functionally configured in the same way (as described in more detail below).

Due to the single end loading capability, the opening 47A at the lower end 47 of the IBOP is not limited by the size of the valves 22, 24. Because both valves 22, 24 are inserted through the opening 46A at the upper end, the diameter of the opening 47A at the lower end is not constrained by a minimum size to receive the valves. Instead, the diameter of the lower opening 47A is free to be smaller than the valves 22, 24. This freedom of design allows the lower opening 47A to be sized for a desired component below the IBOP 20. For example, in one embodiment, a lower single IBOP assembly 300 (shown in FIG. 8) may be attached to the lower end 47 of the dual upper IBOP 20, between the IBOP 20 and the drill string. The lower IBOP valve 300 provides the required regulatory redundancy for safety. In one scenario, the lower IBOP 300 may be smaller in diameter than the dual upper IBOP 20 and may be sized to fit within the drill string or casing string in the wellbore, so that it can be detached from the upper IBOP 20 and deployed into the wellbore as needed. The single-end loading capability of the upper IBOP 20 enables this flexibility in sizing of the lower IBOP 300.

The single-end loading capability of the dual upper IBOP 20 also provides flexibility with other design features at the lower end 47 of the IBOP. For example, in the embodiment shown in FIG. 4, an internal shoulder or step 64 is provided between the threads 47B and the second valve 24. The lower fixed seat 35 rests against this step 64. The diameter of the opening through the step 64 may be smaller than the diameter of the valves 22, 24 and the opening 46A.

The single-end loading capability of the IBOP 20 also enables the two ball valves 30, 32 to have the same configuration with respect to the borehole. Each ball valve 30, 32 includes a ball 36, 37 trapped between two seats, as described above. When the valve is assembled, the fixed seat 34, 35 is inserted first, followed by the ball 36, 37, followed by the floating seat 42, 43. Thus, the floating seat is oriented toward the opening through which the valve was inserted, between that opening and the ball. If the two valves 30, 32 were inserted through different openings, for example the upper valve through an upper opening and the lower valve through a lower opening, then the two floating seats would face away from each other, toward the respective openings, and the two fixed seats would face toward each other. Such a configuration would result in one valve having a fixed seat toward the wellbore, and the other valve having a floating seat toward the wellbore.

By contrast, valves 30, 32 of the single-end loading IBOP 20 in FIG. 4 are both inserted through the upper opening 46A, and therefore both floating seats are toward the top, and both fixed seats toward the bottom. Both valves 30, 32 have the same orientation with respect to the borehole. In FIG. 4, both valves 30, 32 include a fixed seat toward the borehole (toward the lower end 47 of the IBOP) and a floating seat toward the top drive (toward the upper end 46 of the IBOP). If the valve is needed to control a pressure kick, the pressure will originate from the borehole side, lifting the ball 36, 37 off of the fixed seat 34, 35 and pressing it against the floating seat 42, 43. In both cases, the ball is pressed against its respective floating seat, since both floating seats are toward the top end 46. Therefore, the single-end loading capability of the IBOP 20 enables both of the dual valves 22, 24 to have the same configuration (the orientation of the fixed and floating seats) with respect to the high-pressure side, which simplifies design and testing of the valves.

In one embodiment, the single-end loaded dual upper IBOP 20 includes nesting components, which reduce the overall length of the IBOP 20. For example, as shown in FIG. 4, the floating seat 43 for the valve 24 and the fixed seat 34 for the valve 22 are nested, with the seats overlapping each other as noted at area A. The seats 43, 34 each have a stepped shape, with the floating seat 43 fitting within the fixed seat 34. The spring 38 is placed between the two seats, to urge the floating seat 43 toward the lower ball 37. This nested, overlapping configuration reduces the overall axial length of the IBOP 20. Because both valves 22, 24 are loaded into the housing 23 from the same opening, the seats 43, 34 of the two valves can be configured to nest together. Similarly, the upper floating seat 42 and the retainer ring 71 have a nested configuration, overlapping as noted at area B. In one embodiment, the overall length of the IBOP 20 as shown in FIG. 4 is about 24-30 inches.

Figure 8:
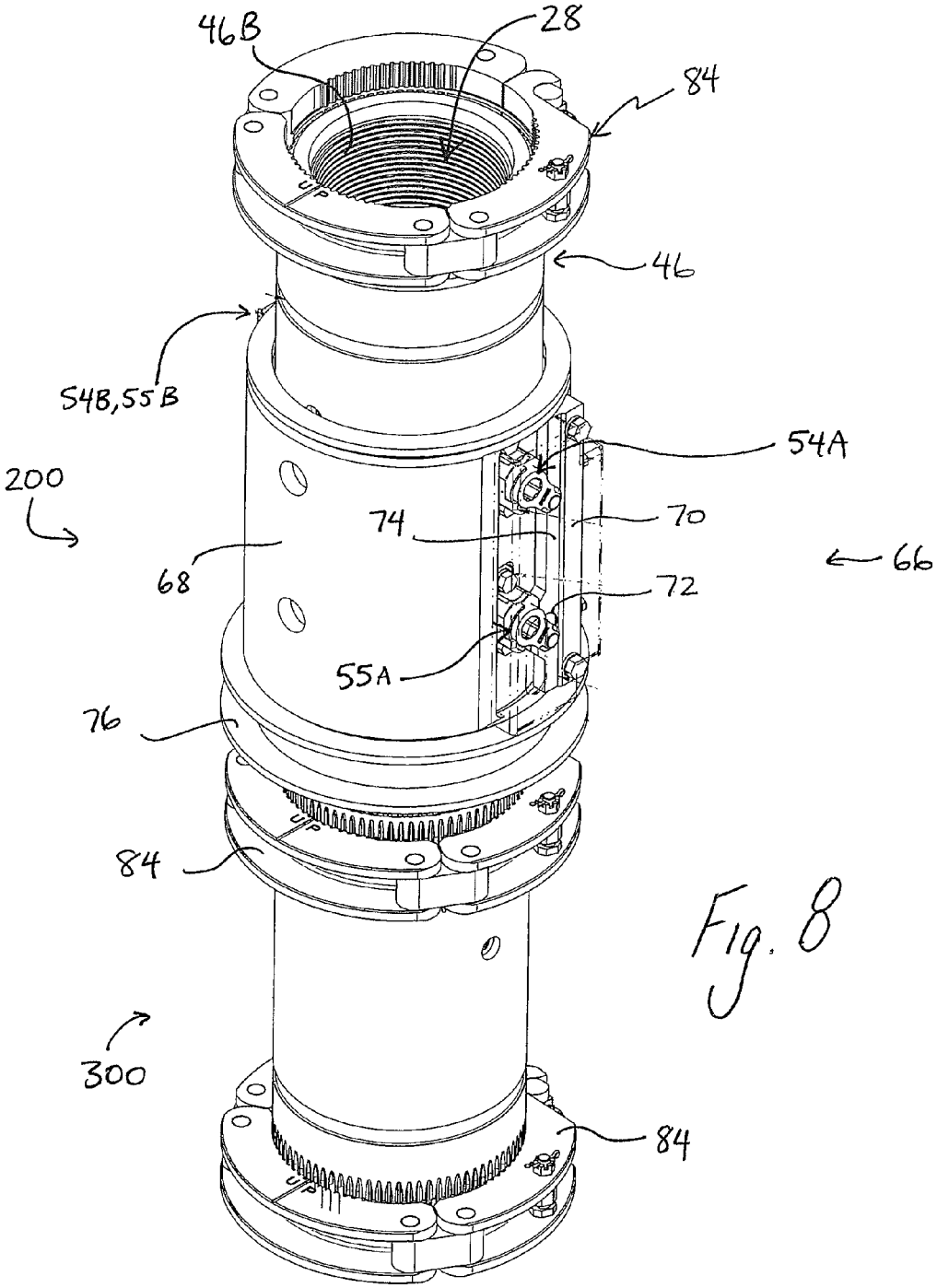
FIG. 8 is an upper perspective view of a dual upper internal blowout preventer with actuator assembly, connected to a lower internal blowout preventer valve, according to an embodiment of the invention.

The upper end 46 of the IBOP 20 includes internal threads 46B, which in one embodiment are configured to mate with the output shaft 26 of the top drive 12. The lower end 47 includes internal threads 47B, which in one embodiment are configured to mate with the drill string, or with a lower IBOP valve such as the lower single IBOP 300 (FIG. 8).

Figure 5:
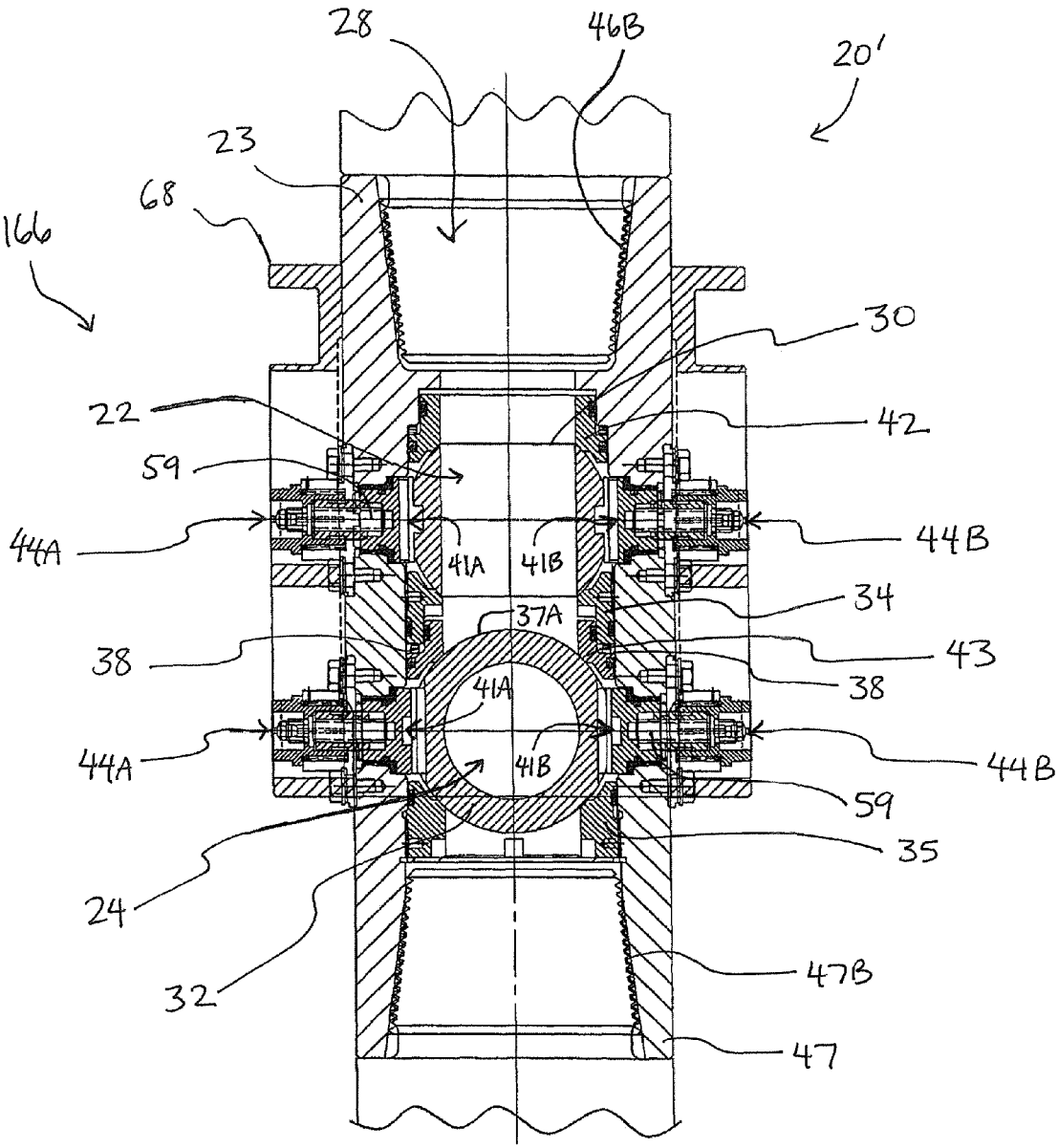
FIG. 5 is cross-sectional view of a dual ball upper internal blowout preventer with a quick change crank mechanism in another embodiment of the invention.

Another embodiment of a dual upper IBOP 20' is shown in FIG. 5. The IBOP 20' includes two valves 22, 24 within a single housing 23. In the embodiment shown, the valves 22, 24 are ball valves. The first valve 22 is shown in the open position, while the second valve 24 is closed. The closed valve 24 has been rotated to move a solid side of the ball 37A into the mud flow path 28, blocking the path. Each valve can be rotated through 90 degrees between the open and closed positions. FIG. 5 also shows an external actuator assembly 166 that is used to operate the valves, to open or close them. As shown in FIG. 5, the actuator assembly 166 includes an actuator shell or sleeve 68 mounted around the housing 23, externally of the two valves 22, 24, and two external crank assemblies 44A, 44B (one on the left side of the figure and one on the right) associated with each valve. The external crank assemblies 44A, 44B for each valve are coupled on one end to the respective internal crank assembly 41A, 41B and at the other end to the actuator sleeve 68. The actuator sleeve 68 moves up and down with respect to the housing 23, to operate the crank assemblies to rotate the valves between the open and closed positions. This is just one of many types and configurations of actuators, however, and other arrangements and configurations of actuators may be used with the dual upper IBOP. Further details of the actuator assembly are described below.

Figure 6A:
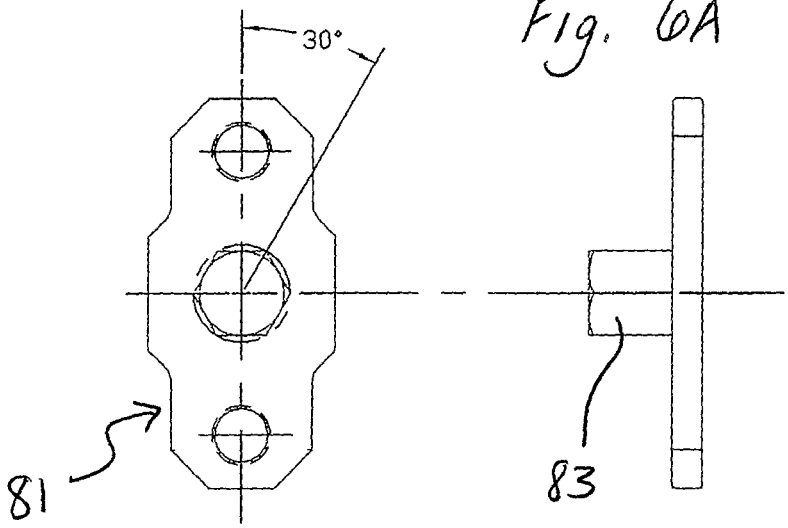
FIG. 6A is a front and side view of a plate for use with a dual upper internal blowout preventer, according to an embodiment of the invention.
Figure 7:
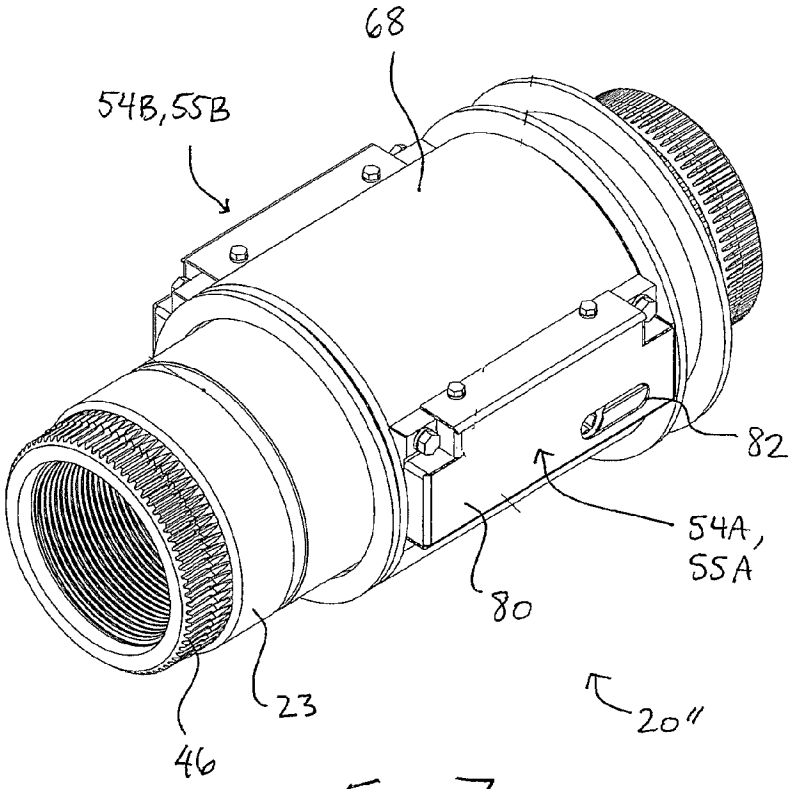
FIG. 7 is an upper perspective view of a dual upper internal blowout preventer with actuator assembly, according to an embodiment of the invention.
Figure 6:
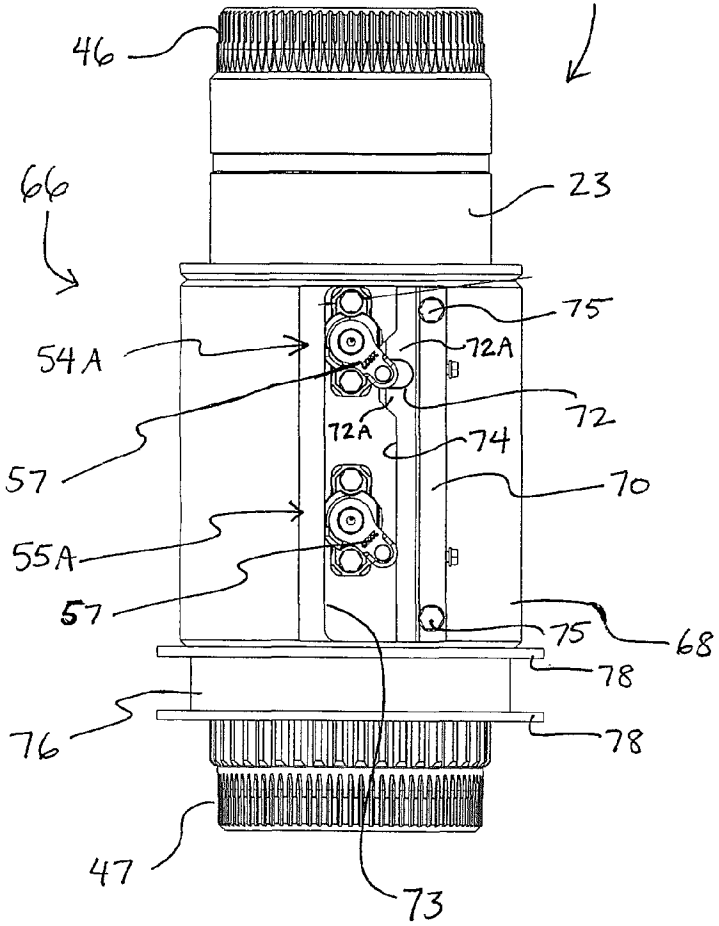
FIG. 6 is a front view of a dual upper internal blowout preventer with actuator assembly, according to an embodiment of the invention.

FIGS. 6-7 show a dual upper IBOP 20" with an actuator assembly 66, according to an embodiment of the invention. The actuator assembly 66 is used to operate the valves 22, 24 within the dual upper IBOP 20". Both valves can be operated by a single actuator assembly. The actuator assembly 66 controls both valves. Because the IBOP 20" is a dual valve assembly with two valves, rather than a single IBOP with only one valve, the actuator assembly 66 is used to perform two functions—to hold one of the two valves in a fixed (typically open) position, and to operate the other valve to open or close it. For example, the first valve 22 may be acting as the primary valve, and the second valve 24 may be the back-up valve. Initially, the actuator assembly holds both valves open, allowing mud or other fluid flow through the IBOP. In the event of a pressure kick, a test event, or a mud-saver function, the actuator assembly 66 can be operated to close the first (primary) valve while continuing to hold the second valve open. Thus the actuator assembly 66 is designed to operate either valve while maintaining the other valve locked in the open position. In an emergency event, both valves can be closed.

As shown in FIG. 6, the actuator assembly 66 includes an actuator sleeve 68 that is mounted externally of the IBOP housing 23 and that is slidable with respect to the housing 23. To operate the valves, the actuator sleeve 68 engages four external cranks 54A, 54B, 55A, 55B coupled to the two valves 22, 24, respectively. Two of the cranks 54A and 55A are visible from the view in FIG. 6, and the other two are on the opposite side of the dual upper IBOP 20". The description below refers to the visible cranks 54A and 55A in FIG. 6, and it should be understood that the same operations are taking place on the opposite side with cranks 54B and 55B.

When the sleeve 68 is translated between the upper and lower ends of the IBOP 20", the sleeve rotates one of the two cranks 54A, 55A to open or close one of the valves, while retaining the other crank in a fixed position. The cranks 54A, 55A are shown in FIG. 6 with their arms 57 pointed downwardly and to the right (in the orientation of the figure). In this position, both valves 22, 24 are open. To close one of the valves, the crank is rotated through 90 degrees in the counter-clockwise direction, until the crank arm is pointed upwardly and to the right.

The cranks 54A, 55A extend externally of the housing 23 to engage the actuator sleeve 68. The cranks 54A, 55A include a projection such as an internal arm 59 (shown in FIG. 5) that engages the hexagonal hole 50 of the internal crank assemblies 41A, 41B (shown in FIG. 4). As a result, rotation of the external cranks 54A, 55A is transmitted to the internal crank assemblies 41A, 41B. The internal crank assemblies 41A, 41B fit into a slot in the outer surface of the balls, as described above, and thus rotation of the internal cranks causes a corresponding rotation of the balls, thus rotating the balls into the open or closed position. The external cranks 54A, 55A pass through a slot 73 in the actuator sleeve 68 to engage the valves 22, 24.

The actuator assembly 66 is configured to operate the first, primary valve between the open and closed positions while maintaining the second, back-up valve in the open position. To rotate one crank but not both cranks, the actuator sleeve 68 is provided with a plate 70 bolted to the sleeve. The plate includes a recess 72 that receives an end of the arm 57 of the first crank 54A, and a stop or wall 74 that contacts an end of the arm 57 of the second crank 55A. When the actuator sleeve 68 is moved toward the upper end 46 of the IBOP, the plate 70 moves with the sleeve, and the wall 74 slides along the second crank 55A, preventing the arm 57 of the crank from rotating counter-clockwise. The wall 74 thus prevents the crank 55A from rotating the second valve 24 into the closed position. The wall 74 retains the second valve 24 in the open position. At the same time, as the sleeve 68 and plate 70 move upwardly, the recess 72 and its side edges or arms 72A engage the arm of the first crank 54A and rotate it counter-clockwise. The recess 72 is deep enough to allow the crank to rotate through its arc. This in turn rotates the first valve 22 into the closed position. Thus, the first valve is closed while the second valve is held open. The sleeve 68 can be translated back down toward the second end 47 to open the first valve, while still holding the second valve open.

The plate 70 can be removed from the sleeve 68 by removing the screws 75. With the plate removed, either crank 54A, 55A can be rotated to the desired position, opening or closing the valves 22, 24. When the cranks and valves are in the desired position, the plate 70 is replaced. The plate can be attached to the sleeve 68 in either of two orientations—with the recess 72 engaging the upper crank 54A or engaging the lower crank 55A. Thus, the plate 70 can operate either crank while holding the other crank in a fixed position, and the fixed position can be chosen to be either open or closed. Typically the fixed position will be open so that the back-up valve is held open while the primary valve is operated.

The actuator sleeve 68 includes a groove or channel 76, which can be located at any convenient position along the sleeve. The groove 76 could alternatively be provided as a space between two rims or flanges 78. The groove 76 receives a yoke 17 (see FIG. 9) which is in turn connected to a hydraulic cylinder or other actuator. The cylinder and yoke move the sleeve 68 up and down with respect to the housing 23, to operate the crank that is engaged with the recess 72. The groove 76 and yoke 17 are provided to accommodate the rotation of the IBOP 20", as the IBOP is rotated along with the top drive output shaft 26 and the drill string. The yoke 17 does not rotate with the IBOP. The groove 76 and rims 78 allow translational force from the yoke 17 to be transmitted to the sleeve 68 while isolating the yoke 17 from rotation of the IBOP. The cylinder can be controlled remotely, such that operation of the cylinder, actuator sleeve, and valves can be controlled from a remote location. A controller may be provided to send signals between a remote control station and the cylinder.

As an alternative to the two cranks 54A and 55A shown in FIG. 6, the non-operational crank (the crank held in a fixed position by the wall 74) can be replaced by a plate such as the plate 81 shown in FIG. 6A. The plate 81 includes a protrusion such as a male hexagonal arm 83 that engages the female hexagonal (or other shaped) hole 50 in the internal crank assembly of one of the two valves (see FIG. 4). The plate 81 is bolted to the housing 23 with the male hexagonal arm 83 engaging the female hexagonal hole 50, to fix the position of the valve and prevent the valve from rotating. The actuator 66 can be used to operate the other crank, to rotate the other valve between the open and closed positions. The plate 81 provides a secure way to fix the position of the back-up valve, such as to lock it into the open position. In this instance, the wall or stop 74 is not needed, as the plate 81 replaces the non-operating crank 55A. To operate the back-up valve, the plate 81 is removed and replaced with the crank (such as crank 55A), which can then be operated by the actuator sleeve 68 to rotate the valve.

The IBOP 20" with actuator assembly 66 is also shown in FIG. 7. This figure shows the dual crank assemblies provided on each side of the IBOP, and indicates the location of the four cranks 54A,B and 55A,B. In this embodiment, each valve includes two crank mechanisms, one on each side of the valve. Also shown in FIG. 7 is a cover plate 80 attached to the sleeve 68 to cover the cranks, the plate 70, and the screws 75. This cover plate 80 is provided to protect these components and to prevent loose components from falling to the rig floor. The cover plate 80 may include one or more windows 82 to view the position of the cranks.

FIG. 8 shows a dual upper IBOP 200 with actuator assembly 66. The actuator assembly is shown with the recess 72 of the plate 70 engaging the lower crank 55A. The dual upper IBOP 200 is attached at its lower end to a single lower IBOP valve 300, which is provided as required by regulation. The single lower IBOP 300 may be attached to the dual upper IBOP 200 via the lower threads 47B (see FIG. 4). Optionally, clamps such as the clamps 84 shown in FIG. 8 may also be provided to secure the connection between the IBOPs 200, 300.

Figure 9:
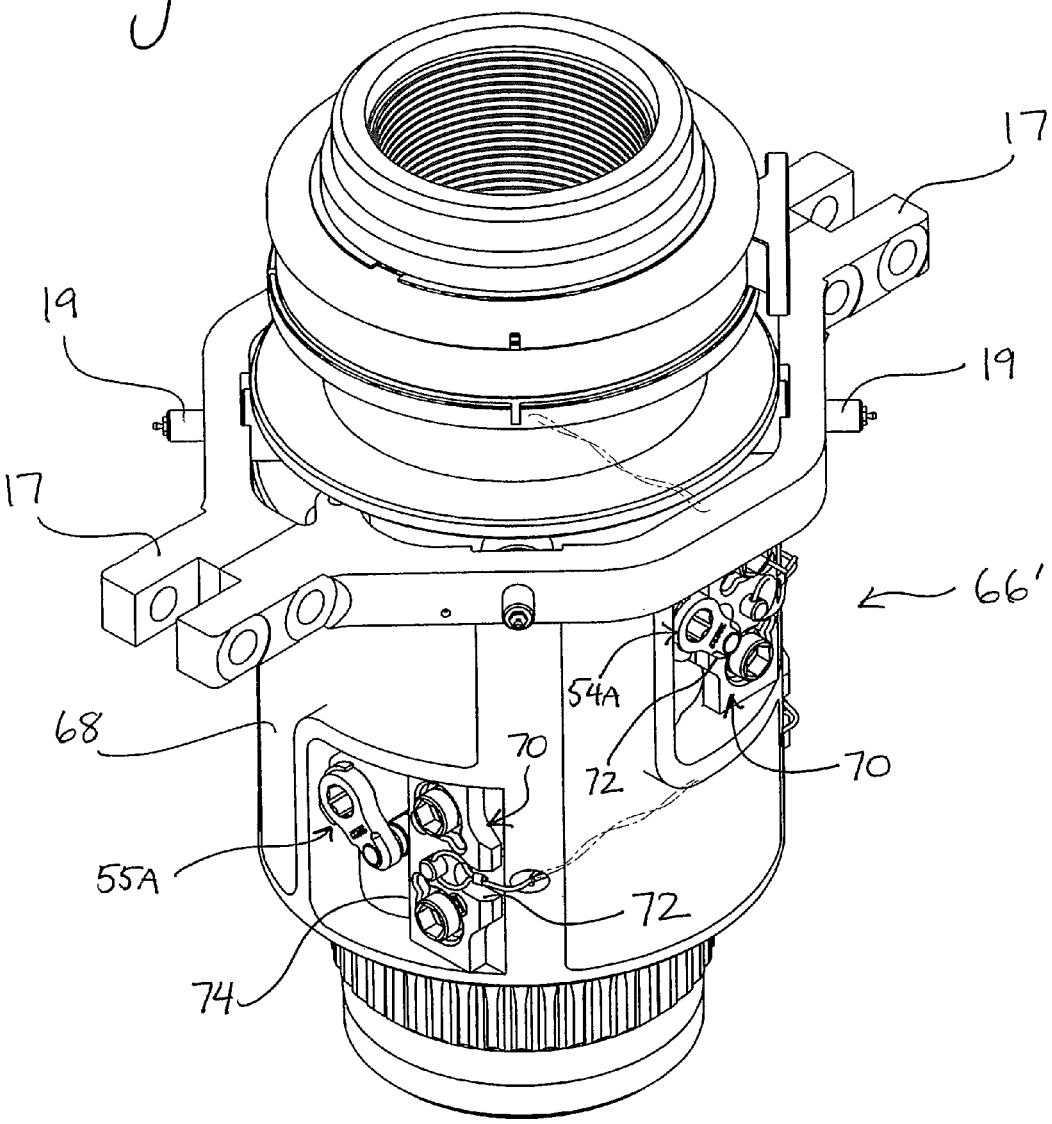
FIG. 9 is a partial side view of a dual upper internal blowout preventer with crank assembly, according to an embodiment of the invention.

Another embodiment of an actuator assembly 66' is shown in FIG. 9. In this case, the cranks 54A, 55A for the upper and lower valves are offset about the circumference of the IBOP. Two separate plates 70 are provided, one to engage each crank. Each plate 70 includes one side with a wall 74 and an opposite side with a recess 72. The plate can be removed and reversed to place either the wall or the recess in engagement with the crank. The crank can be positioned in the desired position to open or close the respective valve, and the plate can then be used to either operate the crank or to retain the crank in the desired position. In FIG. 9, the recess 72 engages the upper crank 54A, which is currently in the open position (pointed down), and the wall 74 engages the lower crank 55A, which is also in the open position (pointed down). FIG. 9 also shows the yoke 17 with two rollers 19 that fit into the groove 76 to transmit translational movement from the yoke 17 to the sleeve 68 while the sleeve 68 is rotating.

Figure 10:
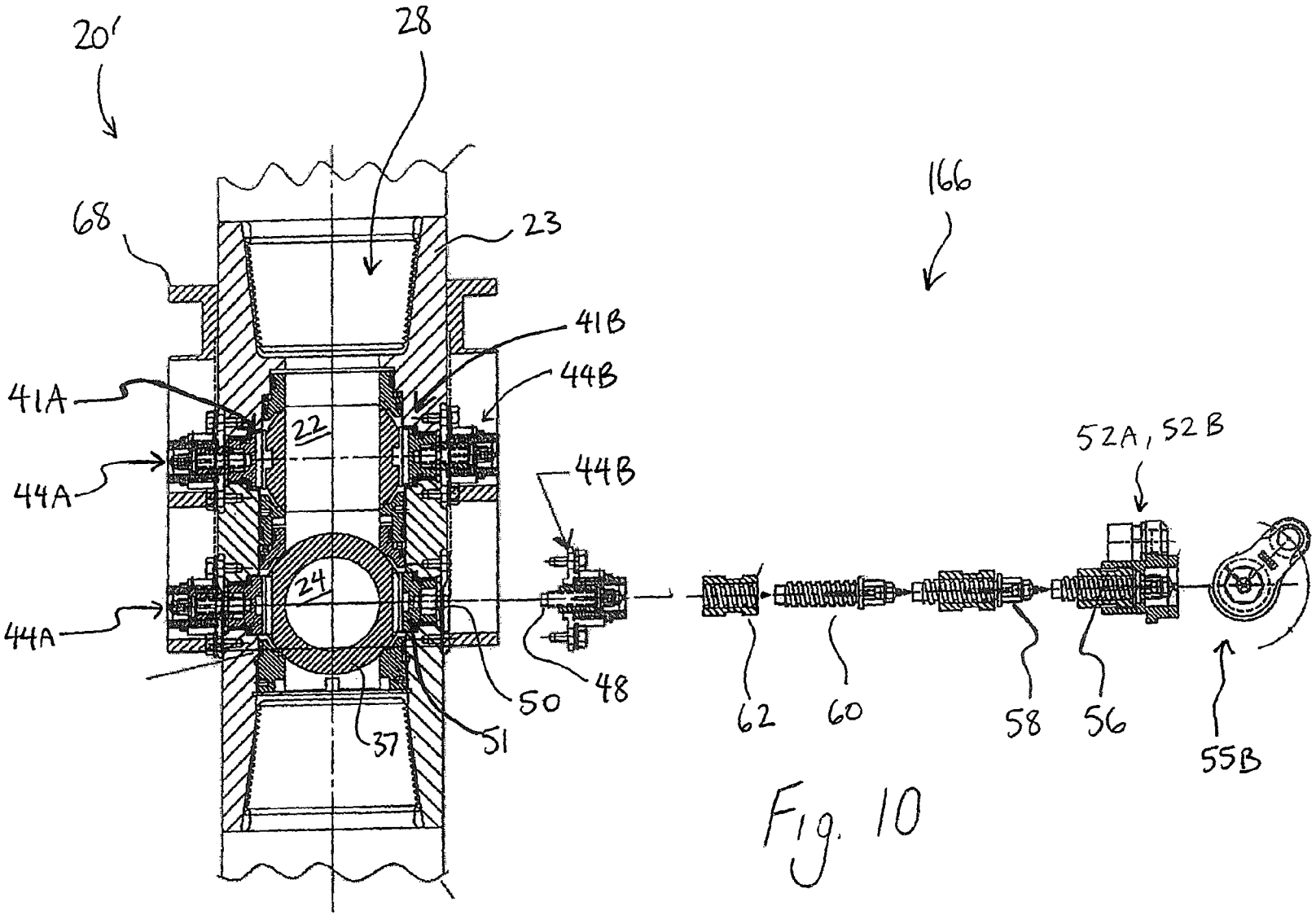
FIG. 10 is an exploded cross-sectional view of a crank actuator assembly for a dual ball upper internal blowout preventer according to an embodiment of the invention.

Another embodiment of an actuator assembly 166 is shown in FIG. 10. This actuator assembly includes a sleeve 68, internal crank mechanisms 41A, 41B, external crank assemblies 44A, 44B, and external cranks 54, 55 (only one of which, 55B, is shown in the figure). The external crank 55B is coupled to the other crank assemblies through several components, and an exploded view is shown in FIG. 10. In this embodiment, the engagement of the sleeve 68 and the cranks 54, 55 utilizes a rotation of a shaft 60 to rotate each valve 22, 24.

Referring now to FIG. 10, disclosed, and externally mounted on the housing 23, are four crank housing actuator assemblies shown generally as 44A and 44B (a pair for each valve 22, 24). Each assembly engages an internal assembly 41A, 41B, which includes a crank 51 that is attached to each ball. Each crank 51 engages the ball 36 such that rotation of the crank 51 causes rotation of the ball. Each crank 51 has a hexagonal hole 50 facing outwardly, away from the ball. The external crank assembly 44A, 44B includes a hexagonal shaft end 48 that mates with the hexagonal holes 50. The mating hexagonal shape of the shaft end 48 and the hole 50 causes rotation of the shaft end 48 to be transmitted to the crank 51, and thereby to the ball. The shaft end 48 is rotated by movement of the shell 68 and crank 54, as described further below.

The vertical motion of the actuator shell 68 is integrated with cam rollers 52A sliding in a horizontal slot 52B. Movement of the shell 68 thus causes an angular movement of the crank 55B. This movement in turn rotates the shaft 60 and the shaft end 48, causing a rotation of the crank 51 and the attached ball. Thus the angular motion of the crank arm assemblies rotates the balls 36, 37 to open and close the valves. The rotation of the crank 55B of the crank assembly 44B is passed through a first threaded sleeve 56 through a hex drive 58 and threaded shaft 60, which then passes through a threaded sleeve 62 to engage the crank assembly 44B and thus the crank 51 and ball 37.

This crank system assembly (44B, 48, 62, 60, 58, 56, 52A, 52B, 55B) is installed over the dual ball upper IBOP valve assembly. An actuator arm assembly such as a yoke shaped arm is provided with two cam rollers that fit into a groove in the actuator sleeve 68, to transmit motion to the sleeve 68 (see FIG. 9). A hydraulic cylinder may be mounted on the rig, for example on a pipe handler frame (see FIG. 2), through a linkage to slide the actuator sleeve vertically up and down. The crank arm assemblies with the cam rollers are captured by a retainer on the crank housing assemblies preventing them from sliding out but allow them the freedom to rotate. The vertical motion of the actuator shell with the crank arm assembly cam rollers sliding horizontally in the slots generates a circular motion applying a torque to rotate the ball valve through 90 degrees either clockwise or counterclockwise directions, to open and close the valve as desired.

The actuator assembly 166 may be used to operate one valve while retaining the other valve open or closed. As described above, the shaft 60, sleeve 62, and end 48 can be connected to the hexagonal hole 50 to transmit rotation from the crank 55B to the ball 37. However, these components can be disengaged such that movement of the actuator sleeve 68 and rotation of the crank 55B does not operate the valve, thus allowing the sleeve 68 to move without actuating the back-up valve. The assembly includes the threaded adjustment sleeve 62 running over the threaded drive shaft 60. A hexagon drive on the end of the drive shaft would screw the threaded adjustment sleeve 62 in and out clockwise and counterclockwise, engaging and disengaging the crank assemblies 44A, 44B of the first and second valves, respectively. The engaged first valve becomes the functional valve and the disengaged second valve becomes the nonfunctional, back-up valve which is maintained open. The threaded adjustment sleeves 62 are automatically locked in that position against the hexagonal hole in the crank housing assembly.

The threaded adjustment sleeves 62 would have two distinct positions—either screwed in clockwise to a stop to engage or screwed out counter clockwise to a stop to disengage the cranks 44A, 44B. The crank that is engaged with the respective crank arm assembly would then either open or close the respective ball valve. The crank arm assembly of the disengaged and locked second valve would continue to go through their angular motions freely similar to the crank arm assemblies of the engaged and operating first valve. However, the disengaged feature of the threaded adjustment sleeves would keep the ball valve from operating and the locked feature would keep the ball valve from accidentally closing. Nylon inserts (not shown) in the threaded adjustment sleeves may provide sufficient friction to prevent inadvertent rotation of the ball when they are in their home positions.

It would be apparent to those skilled in the art that many modifications of the dual upper IBOP valve assembly 20 disclosed herein are possible without departing from the teachings of the present invention. For example, alternate components which are equivalent to components already described herein may be used. In addition it may be desirable to modify the disclosed valve assembly so it may have a different number of crank housing assemblies, each connected to an actuator shell and an actuator arm assembly.

A method of assembling and disassembling a dual upper IBOP is provided according to another embodiment of the invention. To assemble the valves, break-out the existing single upper IBOP valve from the drill string (as done routinely) and install a new dual upper IBOP valve assembly with the new actuator shell 68. The new dual upper IBOP is installed by engaging the upper and lower threads 46B, 47B with the drill string or top drive and/or by clamping the IBOP to the components of the drill string. Once the dual upper IBOP is installed, the actuator shell 68 is positioned over the dual upper IBOP valve assembly in the neutral position so that the horizontal slots for the crank assemblies are lined up with the center of each valve.

Attention must be paid to match the orientation of the hexagonal holes (50) in the internal cranks with the hexagonal shafts (48) in the crank housing assemblies. Next, the four crank housing sub-assemblies are installed and secured. One of the two valves is identified as the operational valve and the other valve as the back-up. For actuator assembly 166, the two threaded adjustment sleeves for the operational valve are screwed in clockwise to their stops. The other two threaded adjustment sleeves, for the non-operational back-up valve, are retracted counter-clockwise to their stops. For actuator assembly 66, the plates 70 are attached with the recess 72 engaging the crank of the operational valve, and the wall 74 engaging the crank of the non-operational valve (or the plate 81 may be used).

When switching from the first valve to the second valve, to reverse functions of the two IBOP valves and utilize the back-up valve, the positions of the threaded adjustment sleeves or plates are reversed.

In one embodiment, a method for operating an internal blowout preventer in a top drive drilling system includes providing an internal blowout preventer with a housing having first and second openings at opposite first and second ends of the housing, and loading first and second valves into the housing through the first opening. The actuator sleeve is then attached to the housing and coupled the actuator sleeve to the first and second valves. The method also includes configuring the actuator sleeve to operate the first valve, and configuring the actuator sleeve to maintain the second valve in a fixed position, such as the open position. The actuator sleeve can then be translated along the housing to operate the first valve.

The present invention has been described in particular relation to the drawings attached hereto, and it should be understood that other and further modifications apart from those shown or suggested herein, may be made within the scope and spirit of the present invention.

What is claimed is:

1. An internal blowout preventer for use in drilling operations, comprising:

a housing having first and second openings at opposite first and second ends of the housing, and having a flow passage between the openings;

first and second valves located in the flow passage in the housing, each valve being movable between an open position in which the flow passage is open and a closed position in which the flow passage is closed; and an actuator assembly coupled to the housing for independently operating the first or second valve, wherein the first and second valves are received into the housing through the first opening, and wherein each valve comprises a ball valve seated between a fixed seat and a spring loaded floating seat, and wherein, for each valve, the fixed seat is between the ball valve and the second opening and the spring loaded floating seat is between the ball valve and the first opening.

2. The internal blowout preventer of claim 1, wherein the second valve and the second opening are separated by an internal step.

3. The internal blowout preventer of claim 1, wherein the first and second openings comprise first and second diameters, respectively, and wherein the first and second diameters are different.

4. The internal blowout preventer of claim 1, wherein the actuator assembly comprises an actuator coupled to the housing externally of the valves, and wherein the actuator is coupled to at least one of the first and second valves such that movement of the actuator with respect to the housing causes movement of the at least one valve between the open and closed positions.

5. The internal blowout preventer of claim 4, wherein the actuator comprises a sleeve, and wherein the actuator assembly further comprises a first crank coupled between the sleeve and the first valve, and a second crank coupled between the sleeve and the second valve, such that translational movement of the sleeve causes rotation of at least one crank, causing a rotation of the corresponding valve.

6. The internal blowout preventer of claim 5, wherein the sleeve comprises a recess and a wall, and wherein the recess engages the first crank and the wall engages the second crank, such that movement of the sleeve causes a rotation of the first crank while preventing a rotation of the second crank.

7. The internal blowout preventer of claim 6, wherein the recess and the wall are provided on a plate coupled to the sleeve, and wherein the plate is reversible to engage the recess with the second crank.

8. The internal blowout preventer of claim 4, wherein the actuator is remotely operable.

9. The internal blowout preventer of claim 1, wherein the actuator assembly comprises a first crank coupled to the first valve to rotate the first valve, a second crank coupled to the second valve to rotate the second valve, a recess engaging the first crank to rotate the first crank, and a stop engaging the second crank to prevent rotation of the second crank.

10. An internal blowout preventer for use in drilling operations, comprising:

a housing having first and second openings at opposite first and second ends of the housing, and having a flow passage between the openings;

first and second valves located in the flow passage in the housing, each valve being movable between an open position in which the flow passage is open and a closed position in which the flow passage is closed; and an actuator assembly coupled to the housing for independently operating the first or second valve, wherein the first and second valves are received into the housing through the first opening, and wherein each valve comprises a ball valve seated between a fixed seat and a floating seat, and wherein the fixed seat of the first valve and the floating seat of the second valve are configured to nest together.

11. A top drive drilling system comprising:

a top drive having an output shaft, the top drive being configured to rotate the output shaft; and a dual internal blowout preventer coupled to the output shaft of the top drive, the dual internal blowout preventer comprising:

a housing comprising a mud flow passage;

first and second ball valves located in series in the mud flow passage, each ball valve being rotatable between open and closed positions to open or close the mud flow passage, wherein each valve comprises a ball valve seated between a spring loaded floating seat and a floating seat;

first and second internal crank mechanisms coupled to the respective first and second ball valves;

an actuator coupled to the housing and movable with respect to the housing; and first and second external cranks coupled between the actuator and the respective first and second internal crank mechanisms, such that movement of the first or second external crank by the actuator causes rotation of the respective first or second ball valve between the open and closed positions.

12. The top drive drilling system of claim 11, further comprising a drill string coupled to the internal blowout preventer.

13. The top drive drilling system of claim 11, wherein the dual internal blowout preventer is an upper internal blowout preventer, and further comprising a lower internal blowout preventer coupled to the dual upper internal blowout preventer.

14. The top drive drilling system of claim 11, wherein the housing comprises first and second openings at opposite first and second ends of the housing, and wherein the first and second valves are received into the housing through the first opening.

15. The top drive drilling system of claim 11, wherein the actuator comprises a sleeve engaged to the housing externally of the valves and movable axially with respect to the housing.

16. A method for operating an internal blowout preventer in a top drive drilling system, the method comprising:

providing an internal blowout preventer comprising a housing having first and second openings at opposite first and second ends of the housing;

loading first and second valves into the housing through the first opening;

mounting an actuator sleeve to the housing and coupling the actuator sleeve to the first valve;

configuring the actuator sleeve to operate the first valve;

configuring the actuator sleeve to engage the second valve to maintain the second valve in position; and translating the actuator sleeve to operate the first valve.

17. The method of claim 16, wherein translation of the actuator sleeve is controlled remotely.

18. The method of claim 16, wherein the first and second openings have respective first and second diameters, the second diameter being different than the first diameter, the method further including coupling a third valve to the second opening.

19. A method for operating an internal blowout preventer in a top drive drilling system, the method comprising:

providing an internal blowout preventer comprising a housing having first and second openings at opposite first and second ends of the housing;

loading first and second valves into the housing through the first opening;

mounting an actuator sleeve to the housing and coupling the actuator sleeve to the first valve;

configuring the actuator sleeve to operate the first valve;

translating the actuator sleeve to operate the first valve;

configuring the actuator sleeve to maintain the second valve in position; and reversing the configuration of the actuator sleeve such that the second valve is operable by the actuator sleeve and the first valve is maintained in position by the actuator sleeve.

20. An internal blowout preventer for use in drilling operations, comprising:

a housing having a flow passage;

first and second valves located in the flow passage in the housing, each valve being movable between an open position in which the flow passage is open and a closed position in which the flow passage is closed; and an external actuator assembly comprising:

a first external crank assembly coupled to the first valve to rotate the first valve between the open and closed positions;

a second external crank assembly coupled to the second valve to rotate the second valve between the open and closed positions; and an actuator sleeve slidably coupled to the housing, wherein during translation of the actuator sleeve along the housing the actuator sleeve rotates the first external crank assembly and engages the second external crank assembly to prevent rotation of the second external crank assembly.

21. The internal blowout preventer of claim 20, wherein the external actuator assembly further comprises:

a recess engaging the first external crank assembly to rotate the first external crank assembly; and a wall engaging the second external crank assembly to prevent rotation of the second external crank assembly.

22. The internal blowout preventer of claim 21, wherein the recess and the wall are provided on a plate coupled to the actuator sleeve, and wherein the plate is reversible such that the recess engages the second external crank assembly and the wall engages the first external crank assembly.

* * * * *